US008667708B2

(12) United States Patent
Tsiantos

(10) Patent No.: US 8,667,708 B2
(45) Date of Patent: Mar. 11, 2014

(54) SOLE FOR SHOES INCLUDING GAS DISPENSER DEVICE

(75) Inventor: Aristeidis Tsiantos, Voula (GR)

(73) Assignee: Voltabo Anstalt, Shaan (LI)

( * ) Notice: Subject to any disclaimer, the term of this patent is extended or adjusted under 35 U.S.C. 154(b) by 500 days.

(21) Appl. No.: 12/990,844

(22) PCT Filed: May 8, 2008

(86) PCT No.: PCT/EP2008/003687

§ 371 (c)(1),
(2), (4) Date: Nov. 3, 2010

(87) PCT Pub. No.: WO2009/135507

PCT Pub. Date: Nov. 12, 2009

(65) Prior Publication Data

US 2011/0056092 A1 Mar. 10, 2011

(51) Int. Cl.
*A43B 7/06* (2006.01)
*A43B 7/00* (2006.01)

(52) U.S. Cl.
USPC ..... 36/3 B; 36/29; 36/103

(58) Field of Classification Search
USPC ..... 36/3 R, 3 A, 3 B, 29, 103
See application file for complete search history.

(56) References Cited

U.S. PATENT DOCUMENTS

| | | | | | |
|---|---|---|---|---|---|
| 2,965,982 | A | * | 12/1960 | Saffir | 36/106 |
| 4,844,194 | A | * | 7/1989 | De Alessi et al. | 180/125 |
| 5,706,589 | A | * | 1/1998 | Marc | 36/27 |
| 7,219,449 | B1 | * | 5/2007 | Hoffberg et al. | 36/88 |
| 7,395,614 | B1 | * | 7/2008 | Bailey et al. | 36/28 |
| 8,375,600 | B2 | * | 2/2013 | Adams et al. | 36/3 B |
| 2007/0011908 | A1 | | 1/2007 | Huang et al. | |

FOREIGN PATENT DOCUMENTS

| | | |
|---|---|---|
| EP | 1 357 057 | 10/2003 |
| GB | 2 248 888 | 4/1992 |
| WO | WO 2007/045828 | 4/2007 |
| WO | WO 2008/083734 | 7/2008 |

* cited by examiner

*Primary Examiner* — Jila M Mohandesi
(74) *Attorney, Agent, or Firm* — Jordan IP Law, LLC; Todd A. Vaughn

(57) ABSTRACT

A sole of a shoe includes a container housing a compressed gas having an active ingredient and an actuator operatively connected to the container. The container has an output for dispensing the compressed gas which is operatively connected to the actuator. The actuator permits closing of the output to restrict delivery of the compressed gas and opening of the output to permit delivery of the compressed gas from the container. The actuator includes an electro-magnet adapted to produce a magnetic field from an electrical current, and a moving element configured to assume different positions under control of the magnetic field and mechanically coupled to the output so as to correspondingly close and open the output.

20 Claims, 14 Drawing Sheets

SOLE FOR SHOES INCLUDING GAS DISPENSER DEVICE

CROSS REFERENCE TO PRIOR APPLICATIONS

The present application is a National Stage Application of PCT International Application No. PCT/EP2008/003687 (filed on May 8, 2008), under 35 U.S.C. 371, which is hereby incorporated by reference in its entirety.

FIELD OF THE INVENTION

The present invention relates to a sole for shoes including a gas dispenser device.

BACKGROUND OF THE INVENTION

It is known that feet are subject to various disorders due to contagion with fungi and bacteria.

In particular, there is a considerable diffusion of fungal dermatitides, namely tinea pedis, commonly known as "athlete's foot", a fungal infection which tends to be increasingly common because of the use of collective facilities such as locker rooms, showers and saunas that are the ideal terrain for reproduction of mycetes.

Dermatological therapy is based essentially on the use of fungicide substances in the form of powders, creams and ointments with treatments which must be continued for some time.

Fungal onicopathies are a frequent complication in athlete's foot and are difficult to treat.

Bacterial dermatitides are rarer but still a problem to be solved. A typical bacterial infection in constituted by whitlows. Periungual and subungual whitlows precede the typical ingrown toenail.

Other problems which affect the foot are hyperhidrosis and the diabetic foot, which is an extremely high podological risk, since ulcers and infections form easily and therefore the foot must be protected adequately with plantar inserts and felts.

Document US-A-2004-0020076 describes a shoe including a shoe body, an ozonizer, an ozone discharge pipe and an air supply unit. The air supply unit includes an air pump provided with a motor connected electrically to a battery. According to this document, the ozonizer could allow disinfection and deodorization of the wear's foot.

SUMMARY OF THE INVENTION

An object of the present invention is that of providing a sole for shoes that allows internal gas dispensing and which can be realized, preferably, in a non excessively complex manner.

In accordance with embodiments, a sole of a shoe includes at least one of the following: a container housing a compressed gas including an active ingredient, the container having an output for dispensing the compressed gas; and an actuator operatively connected to the output to permit closing of the output to restrict delivery of the compressed gas and opening of the output to permit delivery of the compressed gas from the container. The actuator includes an electro-magnet adapted to produce a magnetic field from an electrical current, and a moving element configured to assume different positions under control of the magnetic field and mechanically coupled to the output so as to correspondingly close and open the output.

In accordance with embodiments, a shoe includes at least one of the following: an upper shoe body; and a sole connected to the upper shoe body, said sole including a container housing a compressed gas including an active ingredient, the container having an output for dispensing the compressed gas, and an actuator operatively connected to the output to permit closing of the output to restrict delivery of the compressed gas and opening of the output to permit delivery of the compressed gas from the container. The actuator includes an electro-magnet adapted to produce a magnetic field from an electrical current, and a moving element configured to assume different positions under control of the magnetic field and mechanically coupled to the output so as to correspondingly close and open the output.

In accordance with embodiments, a dispenser device includes at least one of the following: a container housing a compressed gas including an active ingredient and provided with an output for dispensing the compressed gas; an actuator connected to the output and adapted to close and open the output so as to allow delivery of the compressed gas from the container, the actuator including an electro-magnet adapted to produce a magnetic field from an electrical current, and a moving element configured to assume different positions under control of the magnetic field and mechanically coupled to the output so as to correspondingly close and open the output; and a case to house the container and the actuator, the case configured to be placed in a cavity.

In accordance with embodiments, a sole of a shoe includes at least one of the following: a sole body; a container provided in the sole body and housing a compressed gas including an active ingredient, the container provided with an output for dispensing the compressed gas; an actuator operatively connected to the output to close and open the output so as to allow delivery of the compressed gas; a gas emitting output coupled to the output of the container; and a fan device placed adjacent to the gas emitting output to permit recirculation of the compressed gas inside the sole body.

SHORT DESCRIPTION OF THE DRAWINGS

Further characteristics and advantages of the invention will become more clear from the following detailed description of preferred but not exclusive embodiments thereof, illustrated by way of non-limiting example in the accompanying drawings, wherein.

DETAILED DESCRIPTION OF PARTICULAR EMBODIMENTS OF THE INVENTION

Figure 1:
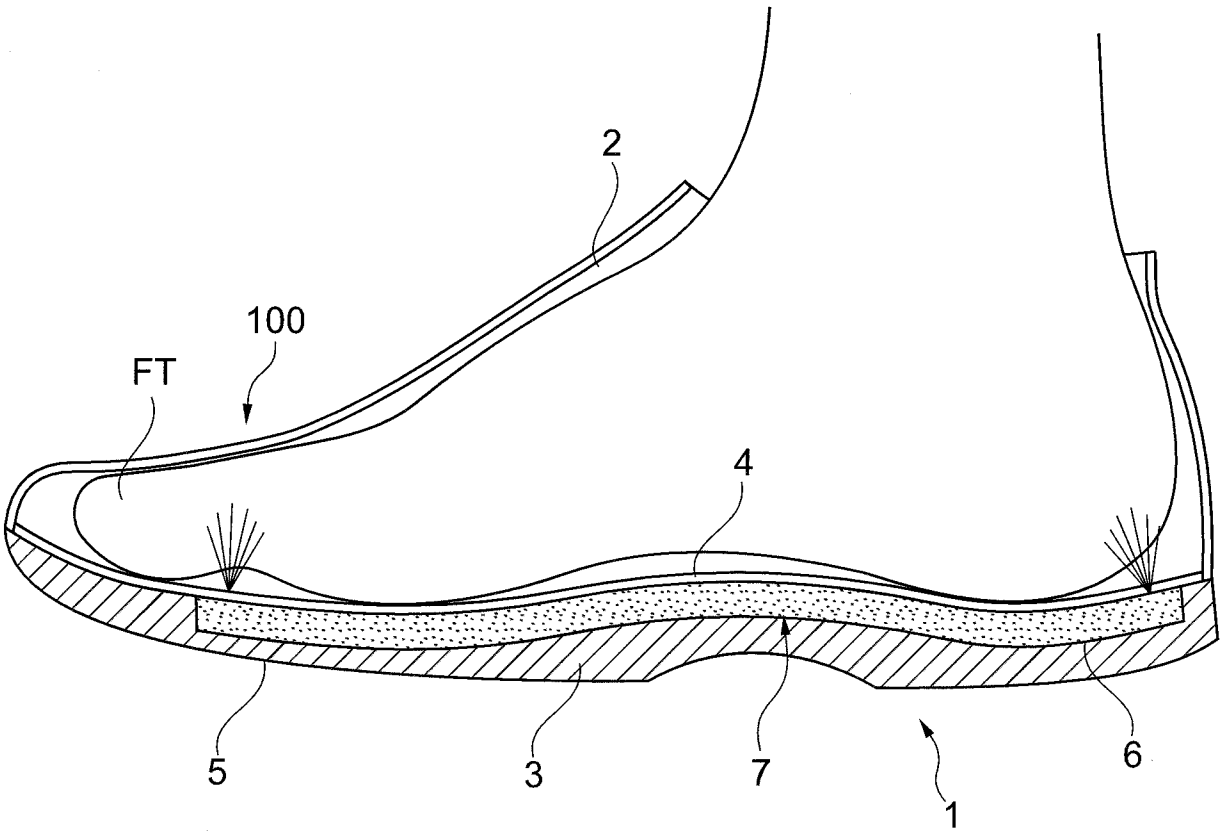
FIG. 1 shows a side section view of a shoe in accordance with an embodiment of the invention.

To the end of the present description, similar or identical elements and components are indicated in the figures with the same numeric referrals. FIG. 1 shows a foot FT wearing a shoe 100 comprising a sole 1 coupled, in a known manner, to an upper 2. The sole includes a solid body 3 made, for example, of rubber and which is provided with a tread 5. An insole 4, made of breathable material, is preferably arranged above the sole 1. The shoe 100 can be prophylactic and/or curative.

A cavity 6 is formed in the solid body 3 to house a dispenser device 7 which is configured to emit a gas including active ingredient or ingredients having an action on the human feet. The gas may be air and the active ingredient may be any substance suitable as an antimycotic, such as for example, clotrimazole, a broad-spectrum antimicotyc which also has trichomocidal activity, and is indicated for the treatment of dermatomycoses. Clotrimazole has a good local tolerability, has no contraindications and no resitance, and is also odourless, non-greasy and non-staining. The gas included into the container 9 may be under the form of spray.

Other antifungal agents can be used, such as fatty acids, tolnaftate, dimazol, amorolfine hydrochloride, econazole nitrate, ketoconazole, terbinafine, tolciclate, fenticonazole nitrate, and any other agent useful for the specific purpose.

The active ingredient may also include an antibacterial agent chosen among aminoglycoside antibiotics, such as neomycin sulphate, kanamycin sulphate, paromomycin, framycetin and among the group of polymixins, such as polymixin B sulphate, polymixin E sulphate.

Other agents which can be used are bacitracin, vancomicyn, rifamycin, tyrothrycin, lincomycin and clindamycin, novobiocin.

In addition to talc (magnesium silicate) it is also possible to use other powders, such as zinc oxide and titanium dioxide. Advantageously, silver ions (AgION) can be employed to perform the antifungal and antibacterial action. Preferably, the gas included in the container 9 can also comprise vasoconstrictor substances (for example, to decrease the foot temperature) or vasodilatator substances (for example, to increase the foot temperature).

Plant-derived substances known for their antibacterial and atimycotic action, such as for example grapefruit seed extract, can also be used.

It is also possible to add aromatic or scented substances adapted to reduce or eliminate the odour generally caused by infections. The gas including the active ingredient may be in an aerosol form.

Figure 2:
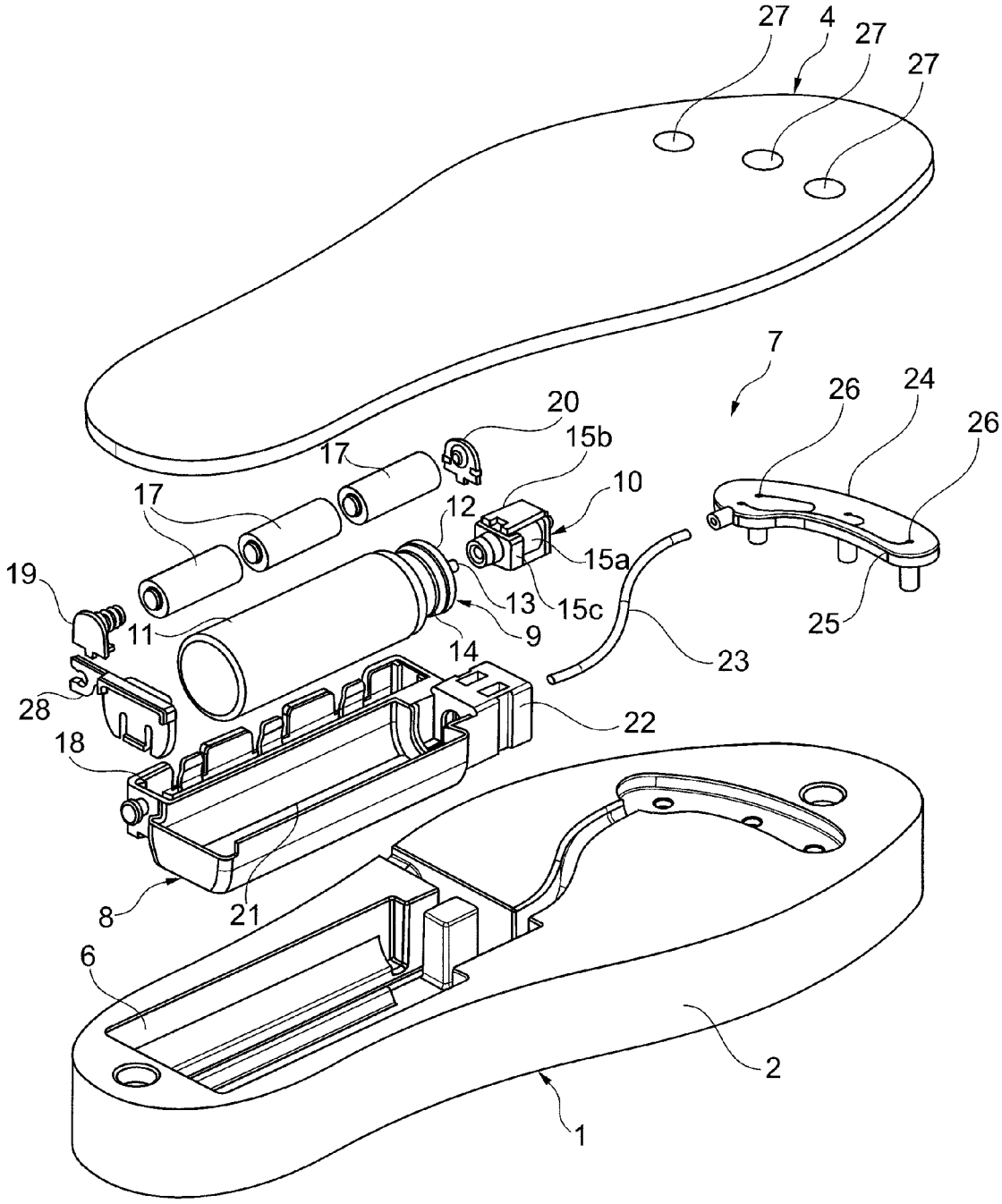
FIG. 2 shows an exploded perspective view of a sole comprising a gas dispensing device according to an example of the invention.

FIG. 2 shows in greater detail the dispenser device 7 including a first housing 8, a gas container and an actuator or actuating means 10. The gas container 9 can be, as an example, a phial (e.g., made of plastic or metal) containing gas (such as, by instance, an aerosol) and provided with a main body having an end provided with an output 12. Advantageously, the container 9 is rechargeable so as to allow refilling of the container 9 with the suitable gas.

The output 12 of the container 9 can be a spray valve of the known type (also known as "aerosol valve"). As clear to the skilled man, in accordance with an example, the output 12 can include a sliding tubular stem 13 provided with a first end having an orifice for the gas delivery and an opposite second end sliding into the container 9. The second end of the sliding tubular stem 13 has an opening lying in a plane transversal to the stem longitudinal axis (not shown) so defining an upper tip and a lower tip. According to this example, the output 12 also includes a gasket 14 and a valve cup, positioned inside the container 9, on which a coil spring exerts an elastic strength (not visible in the figures). In normal conditions, the valve cup under the effect of the coil spring engages the lower tip of the sliding tubular stem 13 so as to stop up the second end of said stem 13. When a longitudinal pressure is exerted on the sliding tubular stem 13, the latter partially enters the container 9 against the coil spring action. Is this further condition, the container 9 is connected with the sliding tubular stem 13, through the upper portion of the second end of said stem 13, so as to allow that the gas is dispensed from the orifice of the sliding tubular stem 13. A description of an aerosol valve of a type which can be employed in the dispenser device 7 can be found on the web site: http://en.wikipedia.org/wiki/Aerosol_spray.

Figure 3:
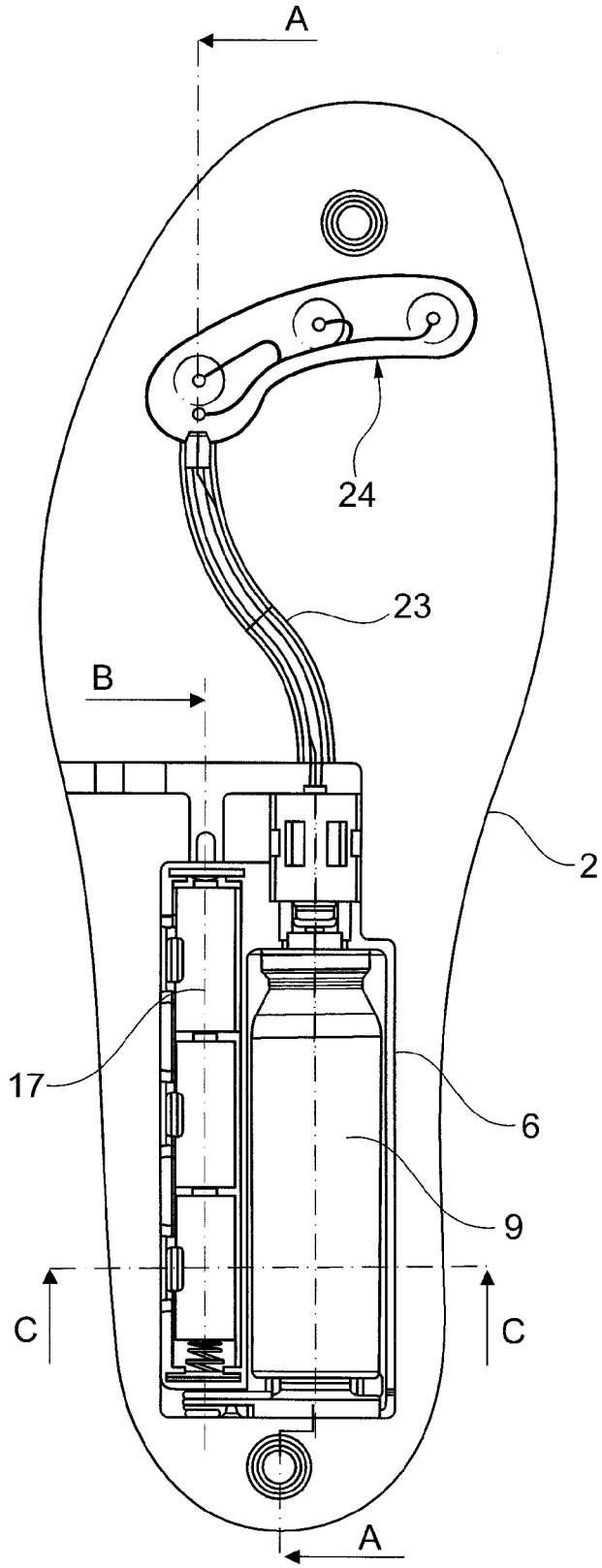
FIG. 3 shows a top view of the sole of FIG. 2.
Figure 4:
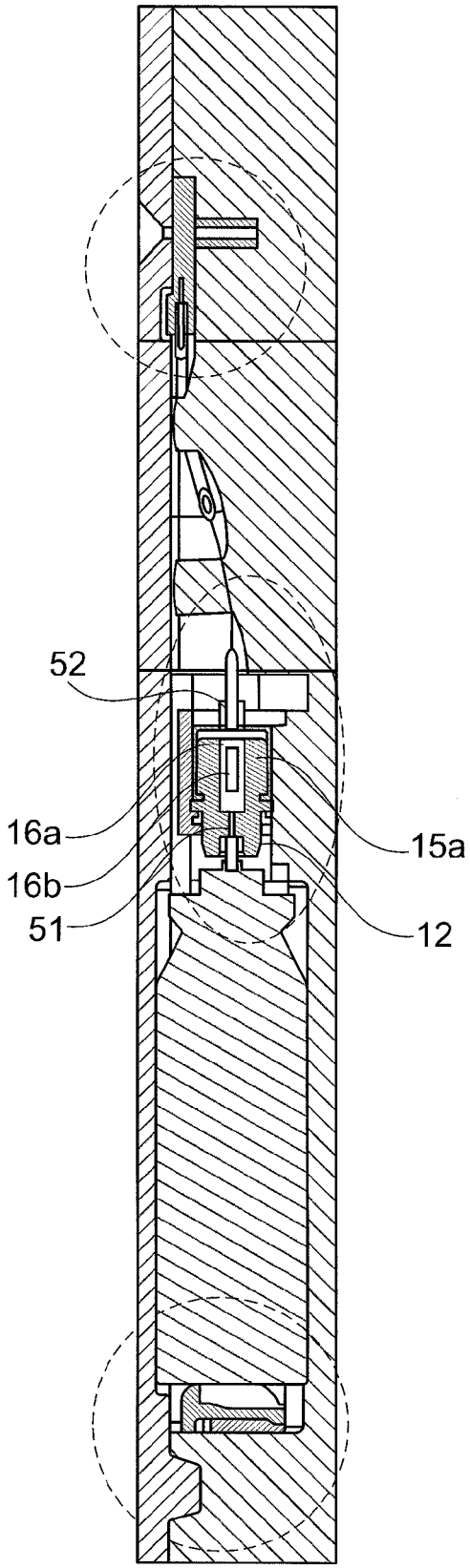
FIG. 4 shows a longitudinal sectional view of the sole in accordance with the line A-A of FIG. 3.

Reference is now made to the actuator 10, as shown also in FIG. 3 and in FIG. 4. The actuator 10 comprises an electromagnet including a coil 15*a* and a ferromagnetic body 15*b*. The coil 15*a* is wound around a support element 15*c* (such as a plastic cylindrical element) having a passing through channel 16*a*. An electrical current fed to the coil 15*a* allows the creation or the modulation of the magnetic field generated by the ferromagnetic body 15*b*.

A moving element 16*b* (such as a cylindrical metallic element) can slide, under the magnetic field action, along said channel 16*a* against the action of spiral spring (not shown). The moving element 16*b* is configured to assume a close position in which it is in contact with the first end of the sliding tubular stem 13 so as to obstruct the orifice of said stem 13, and a open position in which the moving element 16*b* is moved away from the first end of the sliding tubular stem 13 so as to free of obstruction the orifice of said stem 13. The channel 16*a* is provided with a front orifice 51 and an opposite rear orifice 52.

When the moving element 16*b* is in the open position the gas included into the container 9 enters the channel 16*a* through the front orifice 51 and reaches the rear orifice 52.

According to the described embodiment, the container 9 and the actuator 10 are positioned in the first housing 8 in such a way that the output valve 12 is kept in an opened condition. When no electrical current is fed to the coil 15*a* of the actuator 10, the moving element 16*b* is in a close condition wherein it closes the orifice of the tubular sliding stem 13 and so no gas is delivered.

When a suitable electrical current amount is fed to the coil 15*a* of the actuator 10, the magnetic field so generated acts on the moving element 16*b* causing its displacement towards an opened condition wherein the gas can exit the orifice of the sliding tubular stem 13. The gas passes through the channel 16*a* entering the front orifice 51 and exiting the rear orifice 52.

The dispenser device 7 (FIG. 2) further includes at least one battery 17 (for example, three batteries) which can be housed in a suitable seat 18 formed in the first housing 8. In accordance with a particular embodiment, the batteries 17 are electrically connected in cascade and, as an example, each of them is a lithium battery which generates an electrical voltage of 1.5 V and an electrical current of 900 mA. In accordance with a preferred embodiment, the batteries 17 are of the rechargeable type. Two electrical terminals 19 and 20 are connected to the electrical poles of the batteries cascade.

The first housing 8 defines a further seat 21, in which the container 9 can be placed, and a box 22 in which the actuator 10 can be inserted allowing the mechanical and fluidic coupling to the output 12. The rear orifice 52 of the channel 16*a* is connected to a duct 23 (such as a plastic pipe) which links the actuator 10 to a diffuser 24 provided with further channels 25 having openings 26 adapted to allow that the gas exits the dispenser device 7 and reaches the inside of the shoe 100. Advantageously, the insole 4 comprises holes 27 substantially aligned with the openings 26 to allow gas passage.

In addition, according to the particular embodiment shown in FIG. 3 the gas container 9, housed in the seat 21, is kept in a stable position by means of a removable blocking element 28. The dispenser device 7 is placed inside the cavity 6 which has a suitable shape.

Figure 5:
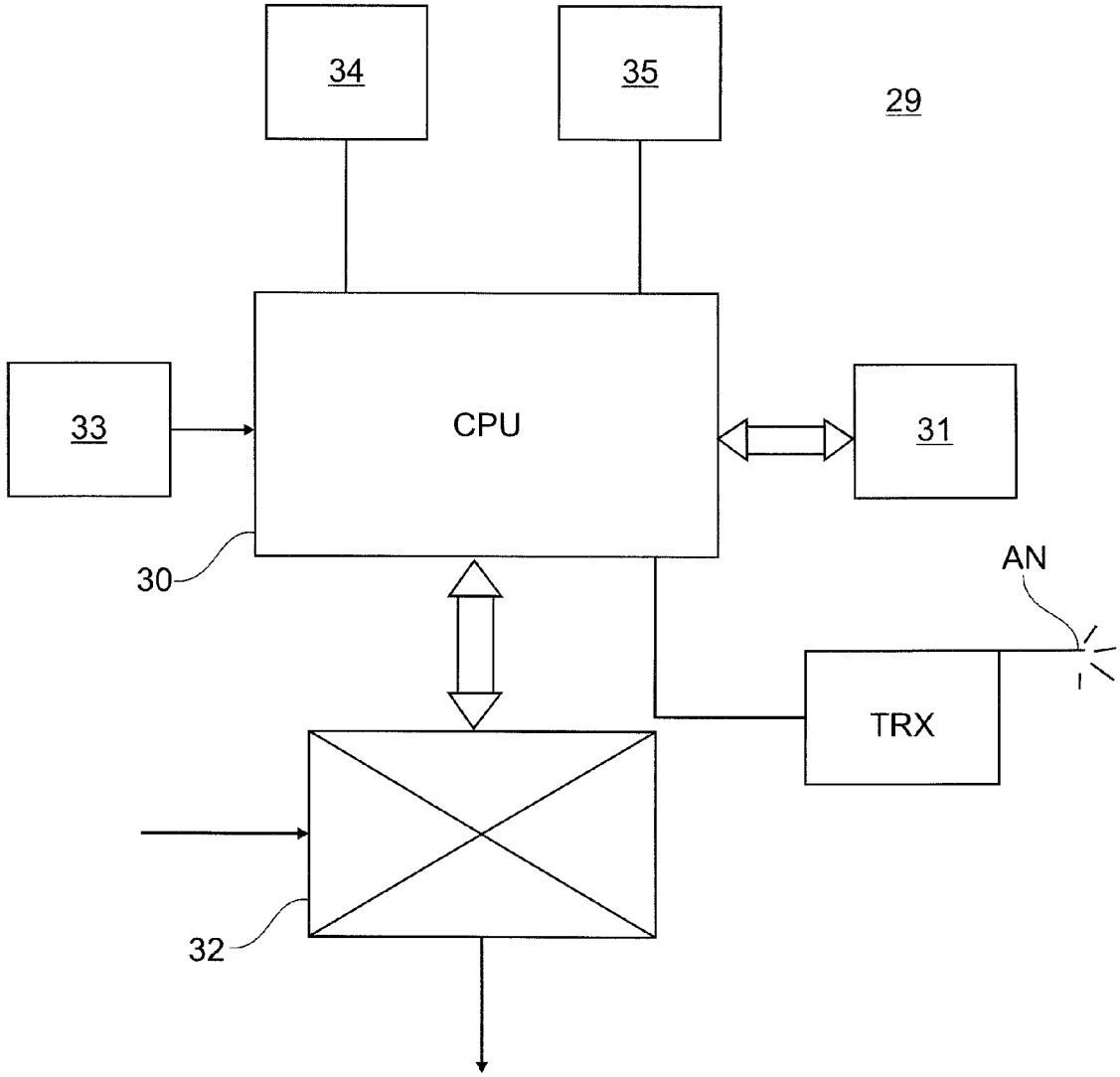
FIG. 5 illustrates in a schematically manner an example of a control device included in said dispensing device.

The dispenser device 10 is also provided with a control device 29 which has been illustrated by functional block in the scheme of FIG. 5. The control device 29 can be inserted into a further cavity formed in the solid body 2 and is electrically connected to the batteries 17 by means of cables, electrical terminals and/or printed conductive paths, in accordance with the specific technology employed.

As schematically shown in FIG. 5, the control device 29 includes a CPU (Central Processing Unit) 30, at least one memory 31 and a power switching device 32 to be controlled by the CPU. The CPU, which is temporarily synchronized by a clock 33, may be a circuit board.

Furthermore, the control device 29 is provided and/or connected to at least one sensor adapted to provide data/information concerning the use status of the shoe. According to an example, the dispenser device 7 comprises a weight sensor 34 and/or a distance sensor 35.

The weight sensor 34 may be a photo-resistance configured to detect when the shoe 100 is worn by the user and emit an electrical signal. The distance sensor 35 may be an infrared sensor which is adapted to sense the distance of the sole 1 from the surface and therefore to sense the motion of the shoe 100, i.e. whether the user is walking.

The switching device 32 operates under the control of the CPU 30 and is adapted to electrically connect the coil 15*a* of the actuator 10 to the cascade of batteries 17 for supplying the coil with a suitable current. The CPU 30 can open the switching device 32 in order to disconnect the batteries 17 from actuator 10.

According to a further embodiment, alternatively to the batteries 17, the dispenser device 7 can be powered by an electromagnetic recharge device, similar to that of an automatic wrist-watch, whereby a capacitor accumulates energy through the walking action.

In accordance with another embodiment, the upper 2 is provided with a photovoltaic cells panel which converts solar energy into electricity by the photovoltaic effect. As an example, the photovoltaic cells panel can be made according the thin-film technology. The photovoltaic thin-film is electrically connected (e.g. by a thin film technology) to the rechargeable battery cascade 17 or to the control device 29 so as supply the needed electrical power.

FIGS. 6-9 refer to a second housing 40 configured to house part of the components making up the dispenser device 7. The housing 40 shows very reduced sizes and can be easy integrated into a solid body of a sole. It is observed that the components indicated with the same referral numbers employed in the previous figures are identical or functionally analogous to the components of FIGS. 6-9 even if such components have different shape or positions, as it can be easily recognised from the drawings.

Figure 6:
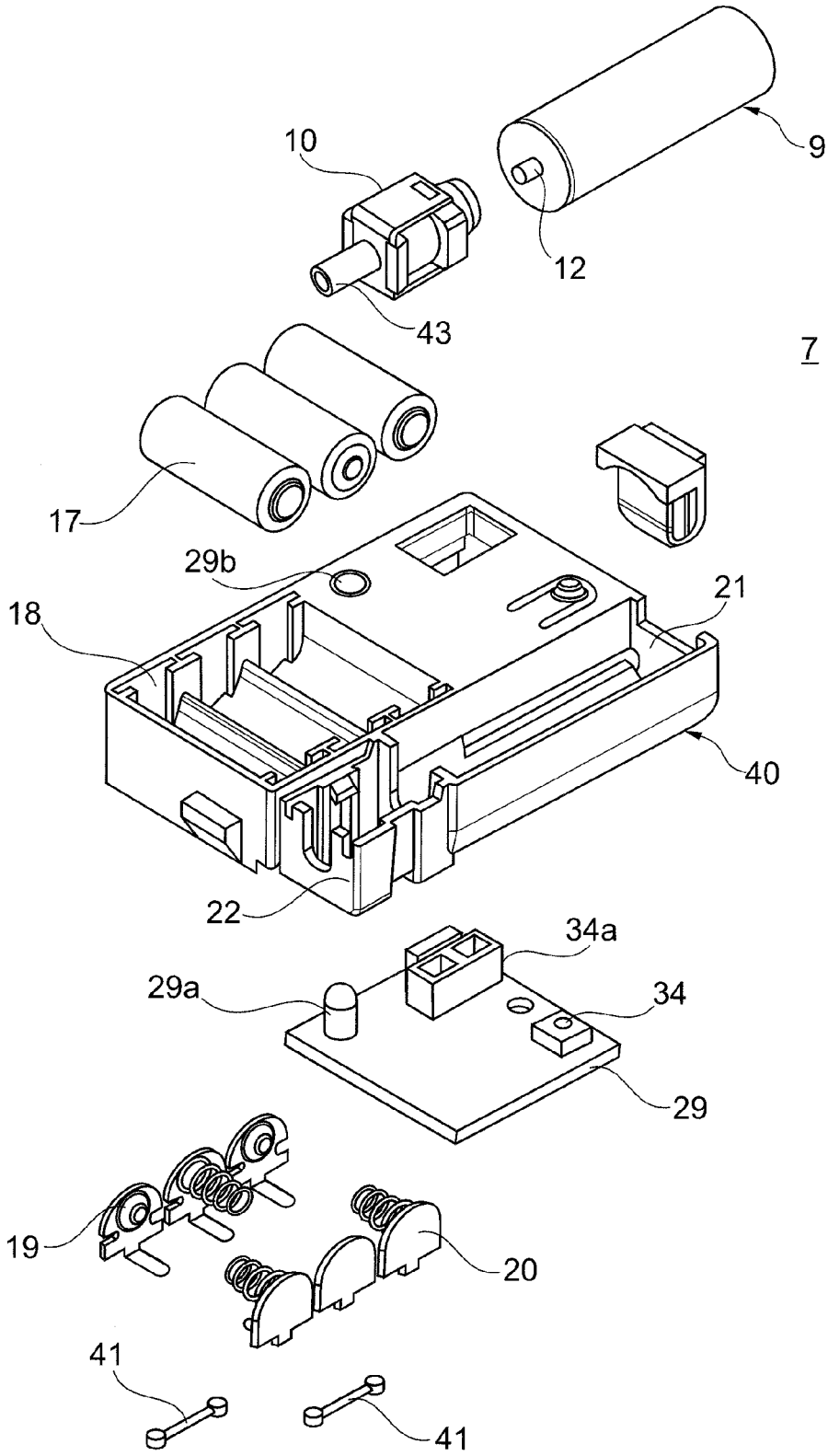
FIG. 6 shows an exploded perspective view of a portion of a further dispensing device according to another example of the invention.
Figure 7:
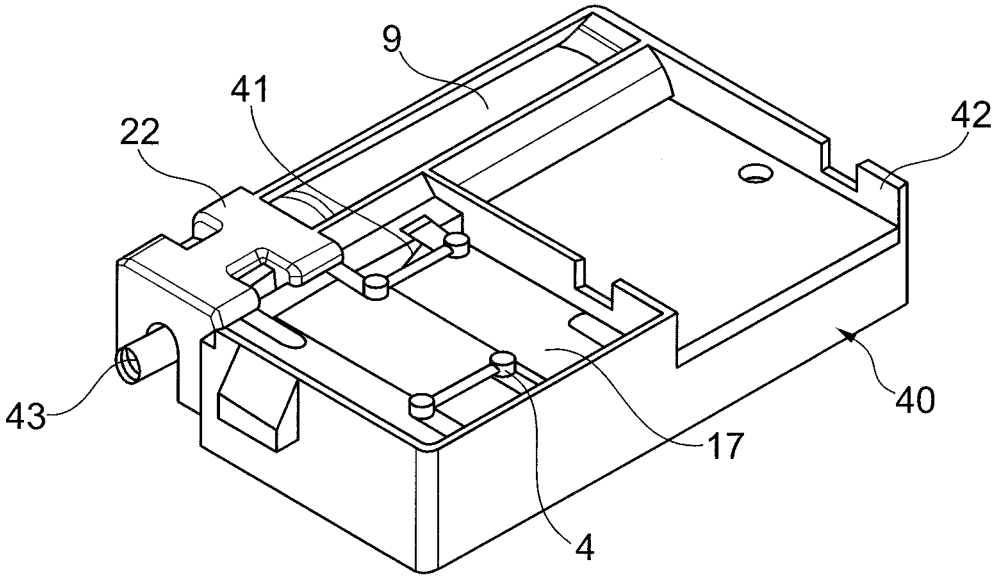
FIG. 7 shows a lower perspective view of said portion of the further dispensing device in an assembled configuration.
Figure 8:
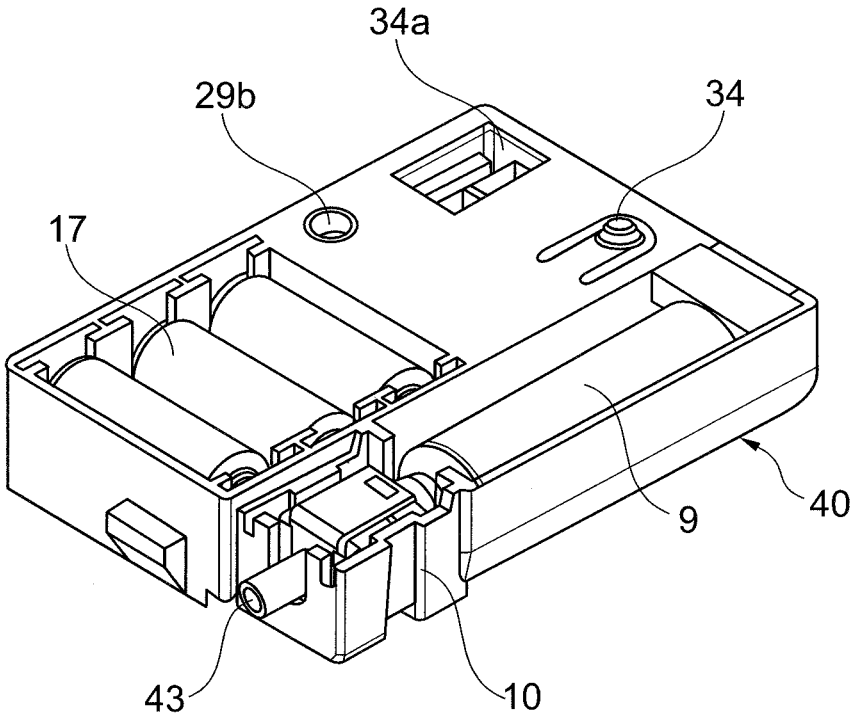
FIG. 8 shows an upper perspective view of said portion of the further dispensing device in an assembled configuration.
Figure 9:
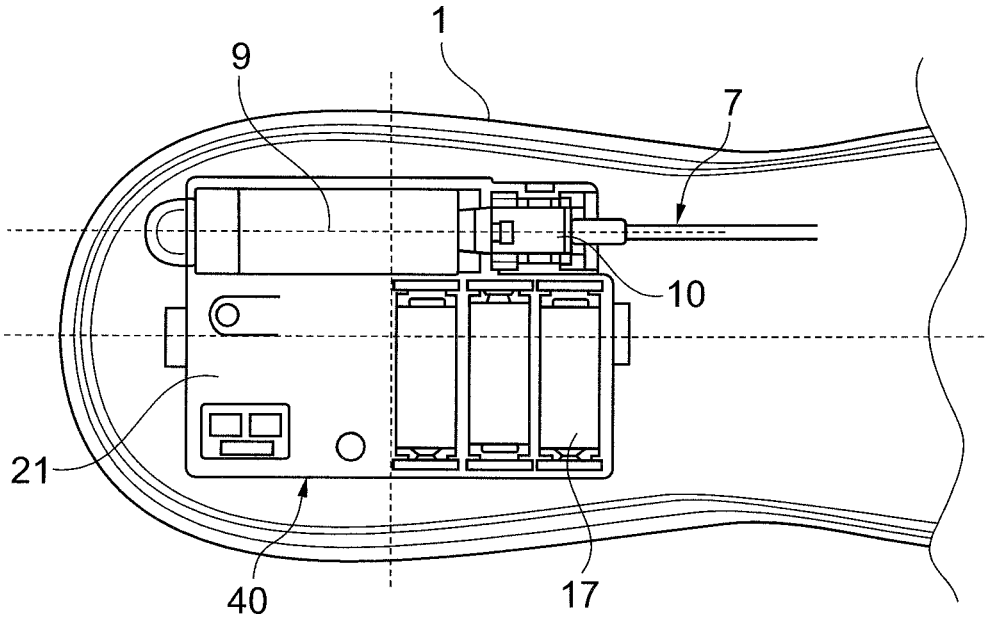
FIG. 9 shows a top view of a portion of a sole including the further dispensing device of FIG. 8.
Figure 10:
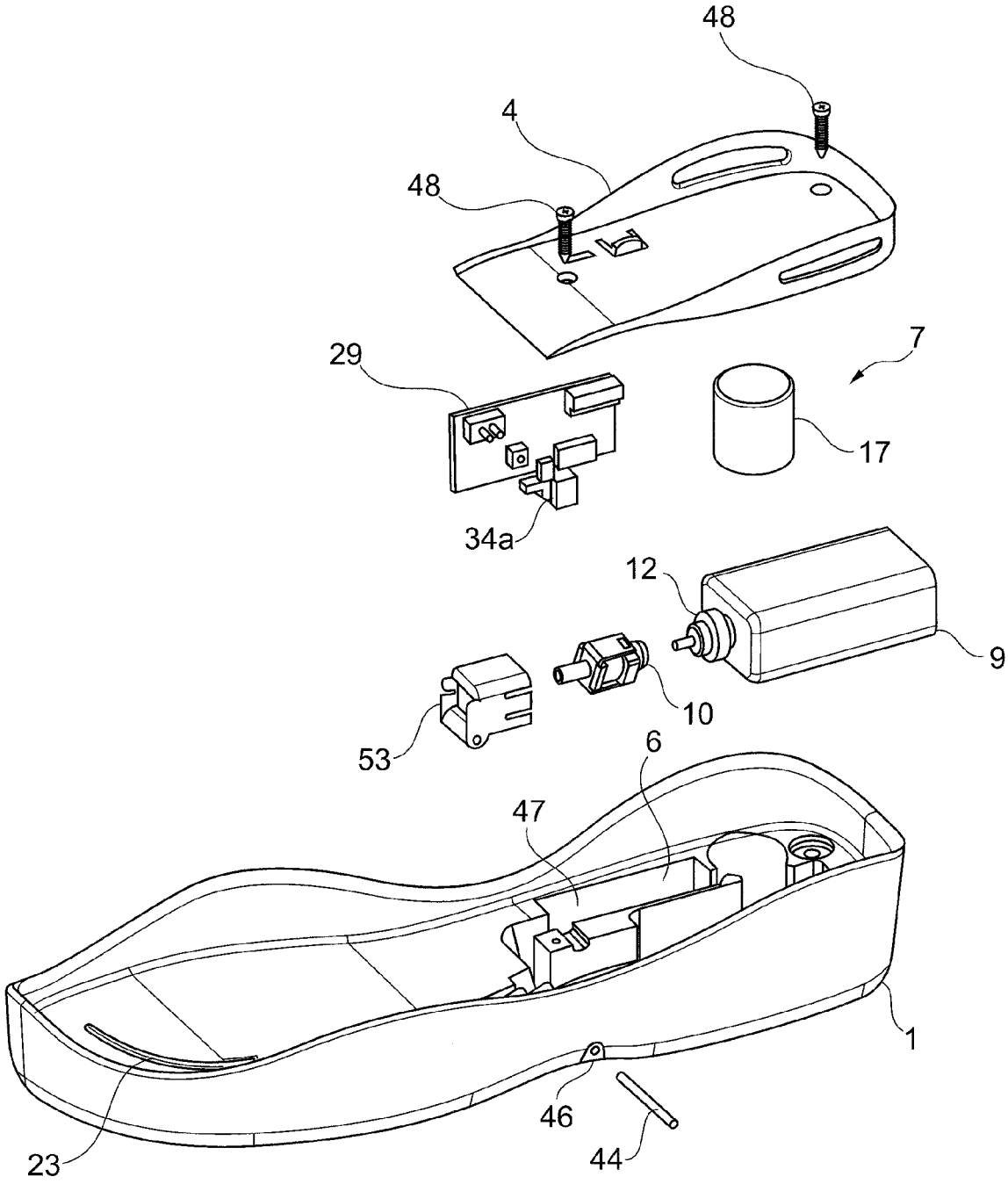
FIG. 10-14 show several views of another embodiment of the sole.
Figure 11:
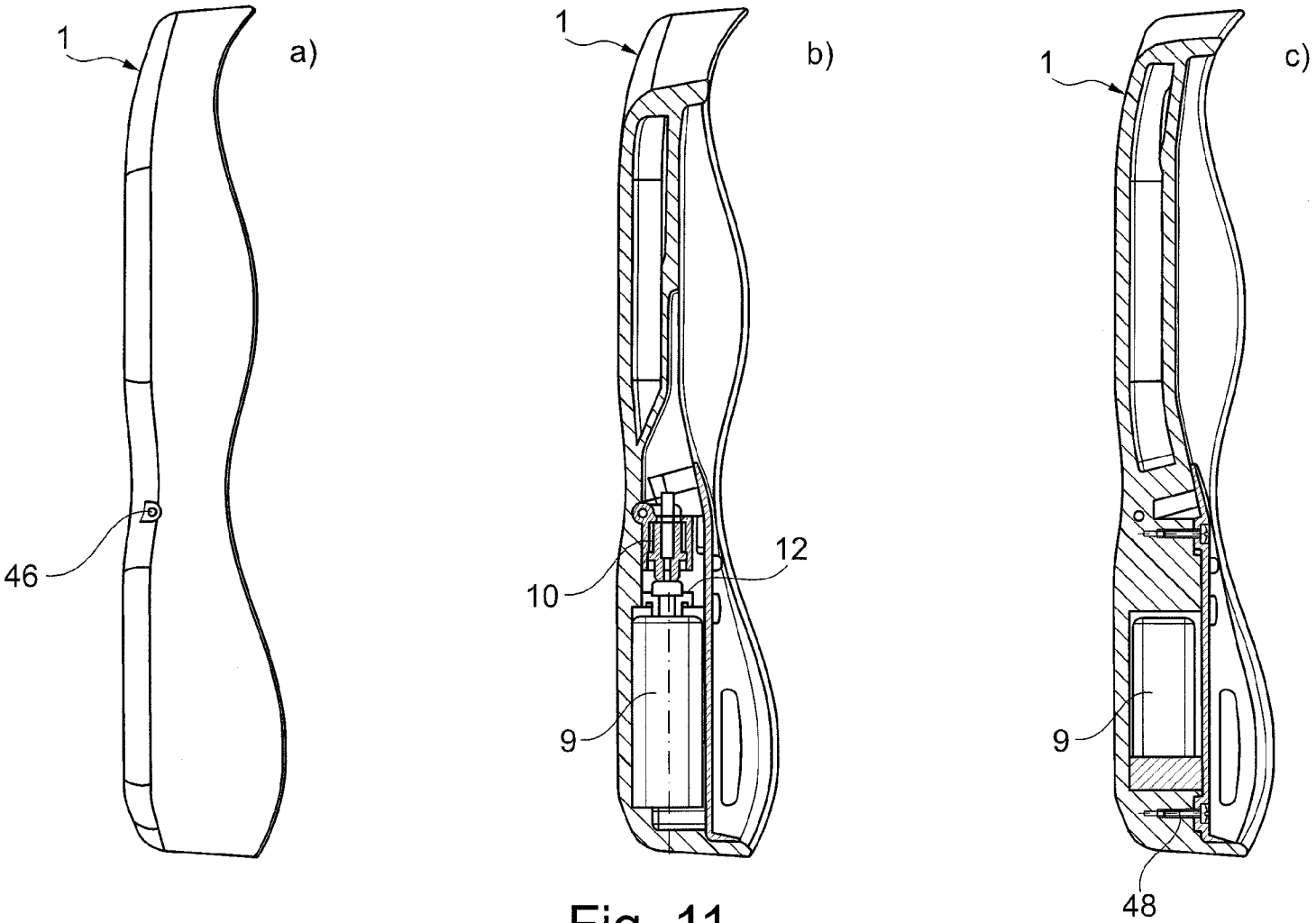
Figure 12:
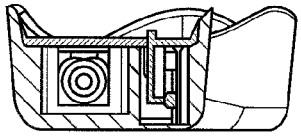
Figure 13:
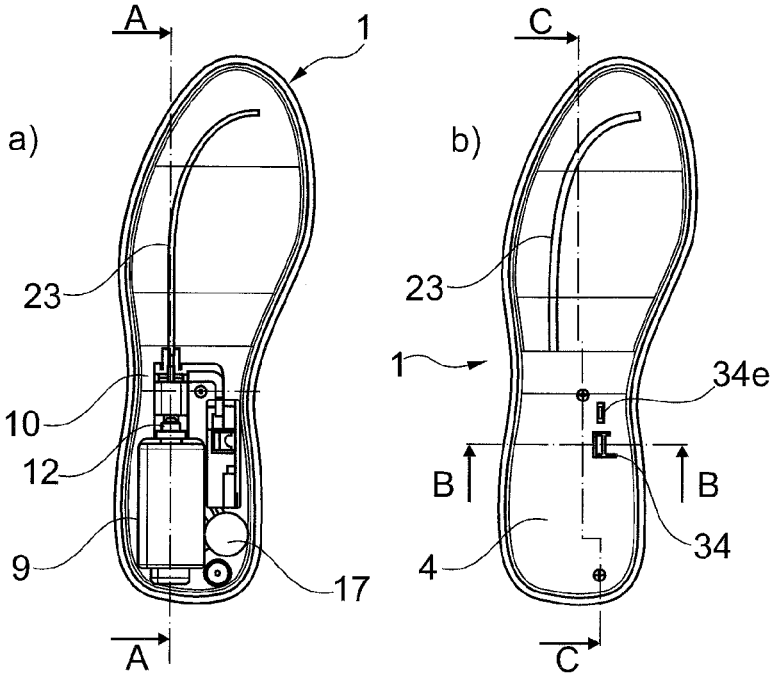
Figure 14:
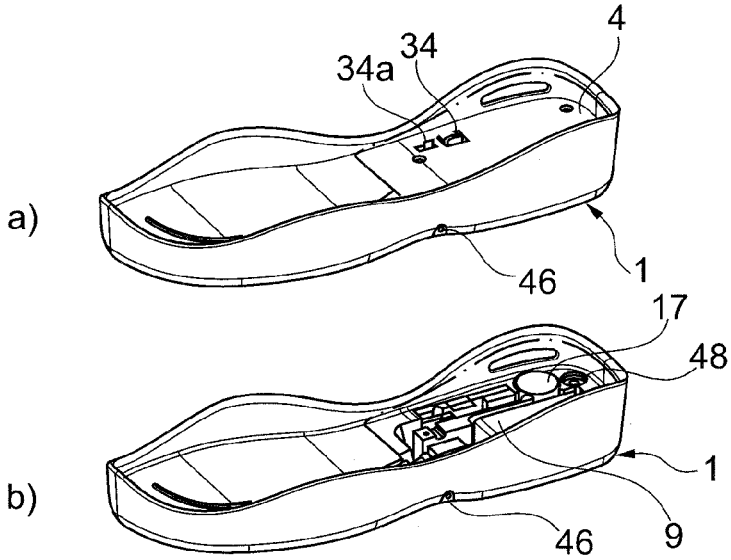

In addition to the already defined components and elements, the embodiment of FIGS. 6-9 comprises a further seat 42 (FIG. 7) adapted to house the control device 29 (such as a printed circuit board) and bridge connecting terminals 41 that allows to electrically connect in series batteries 17 (FIGS. 6 and 7). The control device 29 includes the above defined weigh sensor 34 and, preferably, a frequency switch unit 34*a* comprising, as an example, a command bar (not shown) which can be positioned in different configurations (as an example, three positions). The frequency switch unit 34*a*, which is connected to the CPU 30, allows adjusting the frequency of the activation of the switching device 32 so as to fix a pre-established emitting frequency of the gas including the active ingredients. For example, the gas emission can be activated every two hours, every twelve hours, or every twenty-four hours.

According to another example, the frequency switch unit 34*a* includes a graduated wheel which can be manually rotated to set one particular emitting frequency among a plurality of possible values.

The package of control device 29 is also provided with a pin 29*a* which can be inserted in a hole 29*b* of the housing 40 to keep the whole control device 29 in a steady position.

Advantageously, the control device 29 also includes a wireless transmitter TRX (shown in FIG. 5) and a suitable antenna AN made, for instance, according to the Bluetooth technology. The transmitter operates under the control of the CPU 30 and allows transmit data stored in memory 31 to a mobile phone. Particularly, the transmitter TRx sends to the mobile phone the data registered by the distance sensor 35 and indicating the steps taken by the user and/or data concerning the batteries status. In addition, the control device 29 can also include a receiver to receive command signal from the mobile phone such as messages requesting data or signals setting the CPU 30.

The actuator 10 is provided with a tubular output member 43 which can be coupled to the duct 23.

FIGS. 10-14 illustrate another embodiment of the invention employing a gas container 9 having a rectangular section (as example a diameter of 16 mm) which can contain a gas amount greater than the one included in the container shown with reference to the other embodiments. The actuator 10 is easily inserted and extracted by means of a case 53 which can assume a vertical position to allow the actuator 10 insertion and an horizontal position to allow the coupling with the output 10. An rod element 44 can be inserted in a pass-through hole 46 in order to rotate the oscillate the case 53.

The control device 29 can be placed in a corresponding hollow region 47 in a vertical position. The insole 4 can be fixed to the sole 1 by means of screws 48. Particularly, the duct 23 is a partially opened path (such as a groove), extending towards the anterior portion of the sole 1 so as to allow the gas to invest the human foot 100. Preferably, a plurality of groves 23 forming a web extending under the human foot can be employed.

The sole 1 and the dispenser device 7 have the following operation.

The control device 29 of the sole 1 is automatically activated when the users puts on the shoe 100 as the weight sensor 34 activates the CPU 30. In addition, the distance sensor 35 indicates every time the sole 1 is lifted from the ground and therefore every step taken by the user.

The CPU 30 closes the power switching device 32 and so a suitable current is fed to the coil 15*a* of the actuator 10. The moving element 16*b* assumes the open position and allows gas exiting the output 12 and entering the channel 16*a*. From channel 16*a* the gas reaches the duct 23 and the diffuser 24. The gas is therefore emitted from openings 26 so as to act on the foot FT. After a pre-established time period the CPO open the switching device 32 so as to discontinue current feeding to the coil 15*a*. The moving element 16*b* is displaced by spiral spring and assumes the closed position, closing the front orifice 51 and the orifice of the sliding stem 13.

The CPU 30 is, advantageously, programmed to activate the actuator 10 after a selected number of steps and according to a selected step sequence.

The CPU 30 may also be programmed to dose the amount of gas delivered into the shoe according to a time sequence rather than the number of steps, or according to a combination of time and number of steps. Advantageously, in addition or alternatively to the gas emissions synchronised by the frequency switch unit 34*a*, the control device 29 can be programmed to sending a signal to activate a daily gas emission (for example, a single emission or a plurality of successive emissions).

The time sequence can be monitored on the basis of a reference time unit provided by the clock 33.

It is observed that the use of an actuator such as the one 10 described above and including an electro-magnet 15*a* and 15*b* is particularly advantageous since it ensures rapidity and reliability. In addition, the above described actuator is not complex and not cumbersome and can be easily integrated in a sole of a shoe.

Figure 15:
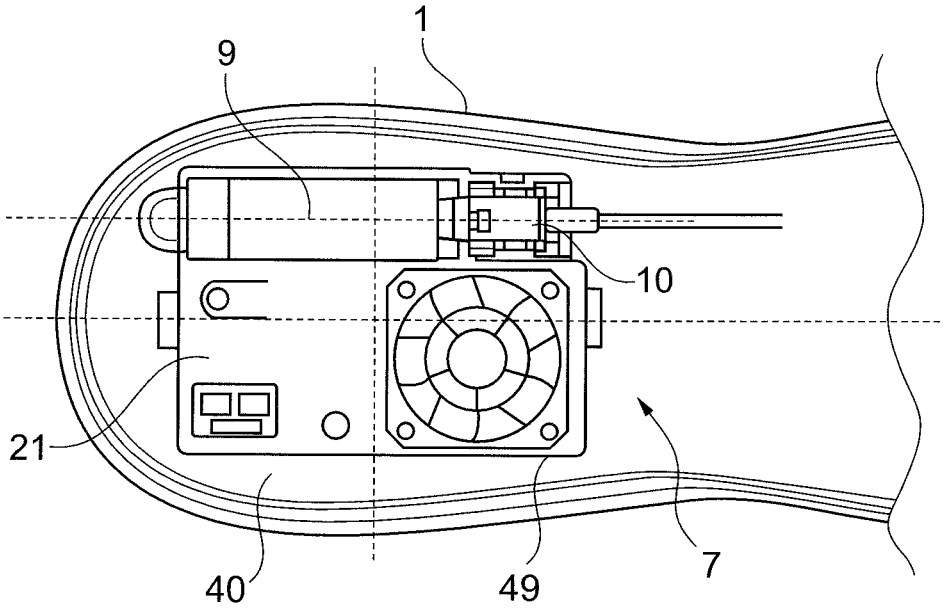
FIG. 15 illustrates a portion of a sole according to a further embodiment of the invention including a fan device.

FIG. 15 refers to a further embodiment of the invention according to which the sole 1 is provided with a fan device 49 (as an example, having a diameter of 16 mm). The fan device 49 comprises one or more rotatable fans and is placed near the tubular output member 43 of the actuator 10 so as to suck up or push a portion of the emitted gas and make it to re-circulate in the posterior zone of the sole 1. This solution shows the advantage of permitting a uniform treatment of the whole foot with the active ingredients. The fans of the device 49 rotate around an axis which can be orthogonal or parallel to the plane on which the sole 1 lays.

The fan device 49 can be, for example, a known device such as the Ultra Slim Fans marketed by Micronel AG-Switzerland which includes a suitable electrical motor to rotate the fans.

As an example, the following fan models could be used: F16/U16 (volumetric flow rate: 12 liters/minute); F17 (15 liters/minute); F25 (52-64 liters/minute). The volumetric flow rate can be chosen according with the particular need and use of the shoes. As an example, in a high temperature climate a fan device with a great volumetric flow rate is particularly advantageous.

The above mentioned models of the fan device 49 allow integration in the heel of the shoes 100 and show a limited electrical power need.

It is observed that the embodiment including the fan device 49 is particularly advantageous since it allows external air and gas including the active ingredient circulate in the shoe 100 so as to reduce the internal humidity due to foot transpiration or associated with drops carried by the gas emitted by the container 9. The fan device 49 causes the wet portions of the aerosol or spray emitted by the container 9 to evaporate (in a very rapid manner) while the active ingredients can invest the foot to perform the prophylactic and/or curative action. Humidity reduction has a positive impact against mycoses, bacterial infections and body odours.

The fan device 49 operates under the control of the control device 29 which can connect it to the battery cascade 17 according to a pre-established timetable. Particularly, the control device 29 can be provided with a further switch directly adjustable by the user to connect and disconnect the fan device 49 to/from the battery cascade 17 in order to remove or activate the fan action. Moreover, in accordance with a specific embodiment, the control device 29 can be configured to deactivate the actuator device 10 in such a way that only the fan device 49 is available.

Preferably, the embodiment of FIG. 15 employs said solar cell integrated in the upper 2 to adequately supply the electrical voltage to the rechargeable battery 17 so as to allow that a suitable current is fed to the actuator 10 and the fan device 49.

Figure 16:
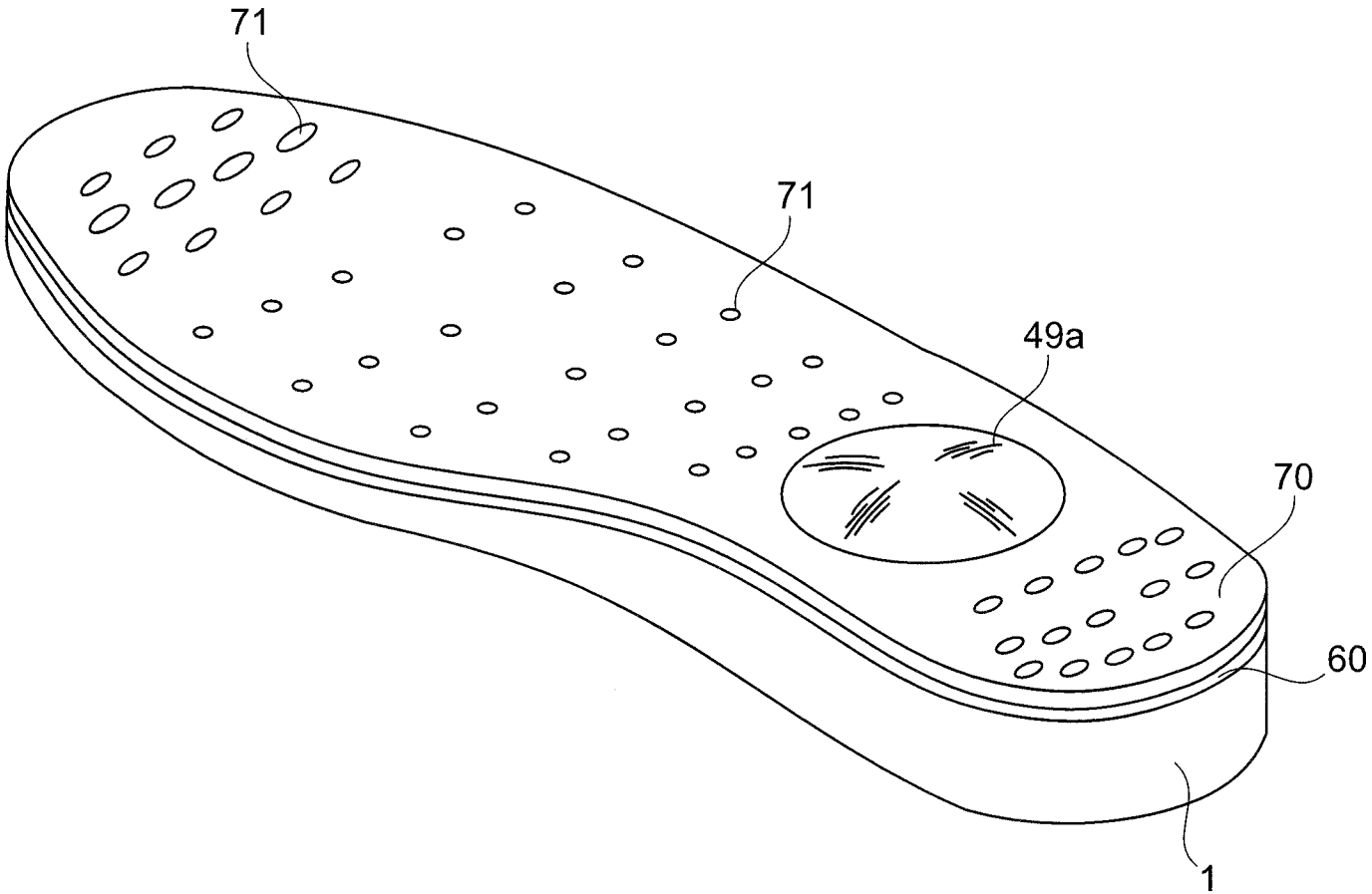
FIGS. 16 and 17 illustrate another embodiment of a sole provided with a dispenser device and a fan device.
Figure 17:
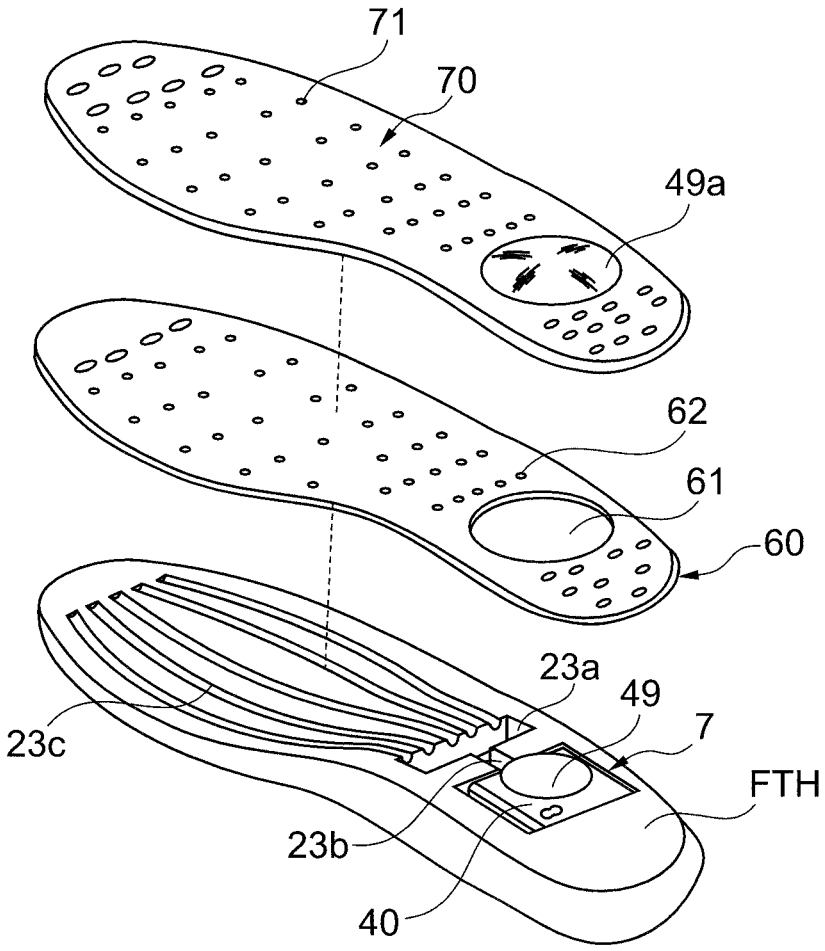

FIGS. 16 and 17 illustrate another embodiment of the sole 1 provided with a dispenser device 7 including the fan device 49 in addition to the other components described above. The sole 1 shown in FIGS. 16 and 17 includes an intermediate channel 23*b* connecting the output member 43 of the actuator 10 to a distribution cavity 23*a* which is connecting to a plurality of groves 23*c*. Moreover, the sole of FIGS. 16 and 17 comprises an intermediate pad 60 provided with a circular hole 61 substantially aligned with the fan device 49 and holes 62 positioned at the anterior and posterior (i.e. the heel) portions of the human foot. Said sole is also provided of a shoe pad 70 having a cover 49*a* for the fan device 49 and a further plurality of holes 71 distributed at the anterior or posterior portions of the human foot.

The sole 1 can be suitably provided with further channels and holes to allow external air to be sucked up or pushed, made it to circulate in the sole interior and re-emitted outside.

It is underlined that the use of the fan device 49 in combination with the gas container 9 is independent on the typology of the actuator 10. As an example, instead of the above described electro-magnet, the actuator may include an electrical motor acting on the output 12 under the control of the control device 29. Particularly, the actuator can be the one described in the PCT patent application PCT/EP2007/008654 filed on 5 Oct. 2007 in the name of Voltabo Anstalt with reference to FIGS. 7 and 8. This portion of the description of PCT/EP2007/008654 is herein enclosed as reference. The actuator of the output 12 can include a motor, e.g. the motor 524 of the above indicated PCT patent application, and a bar, e.g. the bar 520 of said PCT patent application acting on the output 12.

Advantageously, some or any of the embodiments of the dispenser device 7 above described can be at least partially removed by the user from a sole in order to be inserted in another suitable sole provided with a corresponding housing cavity. For instance, the dispenser device 7 can be removed from a winter shoe to be inserted in a summer shoe, and vice-versa.

It has to be further observed that the present invention can be applied to a sole made of any materials such as, for instance: leather, or rubber. In addition, the shoe 100 can be provided with a high-heel or a low-heel and having any type of shape. As an example, the heel shows a highness comprised between 20 and 22 mm.

What is claimed is:

1. A shoe sole comprising:

a sole body having a first cavity, and a second cavity spaced from the first cavity and which is provided at a forward region of the sole body;

a dispenser device housed in the first cavity and having a container housing a compressed gas including an active ingredient, the container having an output for dispensing the compressed gas including the active ingredient;

a diffuser housed in the second cavity and which is fluidically connected to the dispenser device, the diffuser having openings which emit the compressed gas including the active ingredient to an area inside the shoe; and an actuator operatively connected to said output and said diffuser to permit closing of said output to restrict delivery of said compressed gas including the active ingredient and opening of said output to permit delivery of said compressed gas including the active ingredient from said container, wherein the actuator comprises an electro-magnet which produces a magnetic field from an electrical current, and a moving element which assumes different positions under control of said magnetic field and mechanically coupled to said output so as to correspondingly close and open said output.

2. The shoe sole of claim 1, wherein said electro-magnet includes a coil and a ferromagnetic element.

3. The shoe sole of claim 2, wherein said moving element comprises a cylindrical metallic element.

4. The shoe sole of claim 3, wherein said cylindrical metallic element is adapted to move between a first position which obstructs the output and a second position in which the output is free from obstruction.

5. The shoe sole of claim 1, wherein said output of the container comprises an aerosol valve.

6. The shoe sole of claim 5, wherein said aerosol valve comprises a sliding tubular stem provided with an orifice for permitting the exit of said compressed gas from said container.

7. The shoe sole of claim 6, wherein said actuator further comprises:

a channel having an input orifice coupled to said orifice of the sliding tubular stem to receive said compressed gas including the active ingredient and an output orifice, said moving element being housed in said channel so as to move along the channel via the electro-magnetic field.

8. The shoe sole of claim 6, wherein said moving element is adapted to assume a first position which obstructs the orifice and a second position in which the orifice is free from obstruction.

9. The shoe sole of claim 8, wherein said aerosol valve is in a fixed, open configuration.

10. The shoe sole of claim 1, wherein said cylindrical metallic element is adapted to move between a first position which obstructs the orifice and a second position in which the orifice is free from obstruction.

11. The shoe sole of claim 1, further comprising:

a control device adapted to generate a control signal;

a power supply source which generates an electrical current; and switch device connected to said control device to receive said control signal and selectively connect said power supply source to said actuator.

12. The shoe sole of claim 1, wherein said active ingredient comprises at least one of: an antimycotic agent, an antibacterial agent, an aromatic substance, and a scented substance.

13. The shoe sole of claim 1, further comprising:

a compressed gas emitting output connected to said actuator; and a fan device placed adjacent to the gas emitting output to allow recirculation of the compressed gas including the active ingredient and substantially uniform distribution inside the shoe sole.

14. A sole of a shoe comprising:

a sole body having a first cavity and a second cavity spaced from the first cavity and which is provided at a forward region of the sole body;

a dispenser device housed in the first cavity and having a container provided in said sole body and housing a compressed gas including an active ingredient, the container provided with an output for dispensing the compressed gas including the active ingredient;

a diffuser housed in the second cavity spaced from and fluidically connected to the dispenser device, the diffuser having openings which emit the compressed gas including the active ingredient to an area inside the shoe;

an actuator operatively connected to said output to close and open said output so as to allow delivery of the compressed gas including the active ingredient;

a gas emitting output coupled to said output of said container; and a fan device placed adjacent to the gas emitting output to permit recirculation of the compressed gas including the active ingredient inside said sole body.

15. A shoe sole comprising:

a sole body;

a dispenser device housed in a first cavity of the sole body and which selectively dispenses a compressed gas including an active ingredient into an area inside of the shoe;

an actuator operatively connected to the dispenser device to allow selective dispensing of the compressed gas including the active ingredient;

a control device housed in the sole body and which actuates the actuator;

a weight sensor operatively connected to the control device and which detects when the shoe is worn by the user, wherein the control device is automatically activated when the weight sensor detects the shoe is worn by a user; and an insole having holes aligned with the openings to permit passage of the emitted compressed gas including the active ingredient from the diffuser into the space.

16. A shoe comprising:

an upper shoe body;

a sole connected to the upper shoe body, said sole having a cavity which houses a dispenser device which dispenses a compressed gas including an active ingredient, a diffuser housed in a second cavity of the sole and which is fluidically connected to the dispenser device, the diffuser having openings which emit the compressed gas including the active ingredient to an area inside a space defined by the upper shoe body and the sole, and an actuator operatively connected to said dispenser device to permit delivery of said compressed gas including the active ingredient from said dispenser device into the space; and an insole having holes which correspond to the openings to permit passage of the emitted compressed gas including the active ingredient from the diffuser into the space.

17. The shoe of claim 16, further comprising a control device connected to at least one sensor which provides data concerning a use status of the shoe.

18. The shoe of claim 17, wherein the at least one sensor comprises:

a weight sensor which detects when the shoe is worn by a user; and a distance sensor which detects a motion of the shoe when worn by the user.

19. The shoe of claim 18, wherein the control device activates the actuator after a selected number of steps taken by the user and according to a selected step sequence detected by the distance sensor.

20. The shoe of claim 17, further comprising a frequency switch unit which fixes a pre-established emitting frequency of the compressed gas including the active ingredient.

* * * * *